US011692362B2

(12) United States Patent
Haeberle

(10) Patent No.: US 11,692,362 B2
(45) Date of Patent: Jul. 4, 2023

(54) EQUALIZING BEAM FOR RECEIVING FORMWORK ELEMENTS

(71) Applicant: PERI SE, Weissenhorn (DE)

(72) Inventor: Wilfried Haeberle, Langenau (DE)

(73) Assignee: PERI SE, Weissenhorn (DE)

( * ) Notice: Subject to any disclaimer, the term of this patent is extended or adjusted under 35 U.S.C. 154(b) by 0 days.

(21) Appl. No.: 17/172,719

(22) Filed: Feb. 10, 2021

(65) Prior Publication Data

US 2021/0246673 A1 Aug. 12, 2021

(30) Foreign Application Priority Data

Feb. 10, 2020 (DE) ..... 202020100700.9

(51) Int. Cl.
*E04G 11/56* (2006.01)

(52) U.S. Cl.
CPC ..... *E04G 11/56* (2013.01)

(58) Field of Classification Search
CPC ..... E04G 11/50; E04G 2011/505; E04G 2011/483; E04G 2011/486; E04G 2011/38; E04G 2011/48; E04G 2011/52; E04G 2011/56; E04G 11/483; E04G 11/486; E04G 11/38; E04G 11/48; E04G 11/52; E04G 11/56
See application file for complete search history.

(56) References Cited

U.S. PATENT DOCUMENTS 1,888,738 A * 11/1932 Roos ..... E04G 11/486 249/210
1,907,877 A * 5/1933 Roos ..... E04G 11/486 425/DIG. 129
2006/0042179 A1 3/2006 Vanagan

FOREIGN PATENT DOCUMENTS

| | | | | |
|---|---|---|---|---|
| CA | 2416644 A1 * | 7/2004 | ..... | E04G 11/38 |
| CH | 660049 A5 * | 3/1987 | ..... | E04G 11/56 |
| DE | 801952 C * | 1/1951 | ..... | E04G 11/56 |
| DE | 840435 C * | 6/1952 | ..... | E04G 11/56 |
| DE | 8009761 U1 | 7/1980 | | |
| DE | 8110483 U1 * | 10/1981 | ..... | E04G 11/50 |
| DE | 3921065 C1 | 10/1990 | | |
| DE | 19720885 A1 * | 11/1998 | ..... | E04G 11/56 |
| DE | 19932707 C1 * | 2/2001 | ..... | E04G 11/38 |
| DE | 10035823 A1 * | 2/2002 | ..... | E04G 11/56 |
| DE | 10135664 A1 * | 2/2003 | ..... | E04G 11/486 |
| EP | 0345902 A2 * | 12/1989 | ..... | E04G 11/486 |

(Continued)

*Primary Examiner* — Michael Safavi
(74) *Attorney, Agent, or Firm* — Sleman & Lund LLP

(57) ABSTRACT

An equalizing beam for receiving formwork elements, in particular formwork panels, having an outer beam having a support surface facing upwards when applied and a base surface facing downwards when applied, and at least one inner beam having an additional support surface facing upwards when applied and an additional base surface facing downwards when applied. The equalizing beam further includes at least one immobilizing element. The outer beam has a recess running in its longitudinal direction for receiving the inner beam and the inner beam is movably mounted in the recess of the outer beam. The immobilizing element is provided to secure the position of the inner beam relative to the outer beam. A ceiling formwork system including at least one equalizing beam and at least two supports which are arranged essentially at a right angle to the equalizing beam.

24 Claims, 3 Drawing Sheets

(56) References Cited

FOREIGN PATENT DOCUMENTS

| | | | | | |
|---|---|---|---|---|---|
| EP | 1526226 | A1 | * | 4/2005 | ..... E04C 3/005 |
| EP | 2982813 | | | 2/2016 | |
| EP | 2982813 | A1 | | 2/2016 | |
| ES | 2302655 | | | 7/2008 | |
| FR | 1243767 | A | * | 10/1960 | ..... E04G 11/50 |
| GB | 520747 | A | * | 5/1940 | ..... E04G 11/56 |
| GB | 2265655 | A | * | 10/1993 | ..... E04G 11/486 |
| JP | H0232555 | U | * | 2/1990 | ..... E04G 11/56 |
| KR | 20010054437 | A | * | 7/2001 | ..... E04G 11/56 |
| WO | WO-2012174597 | A1 | * | 12/2012 | ..... E04G 11/38 |

* cited by examiner

Fig. 3
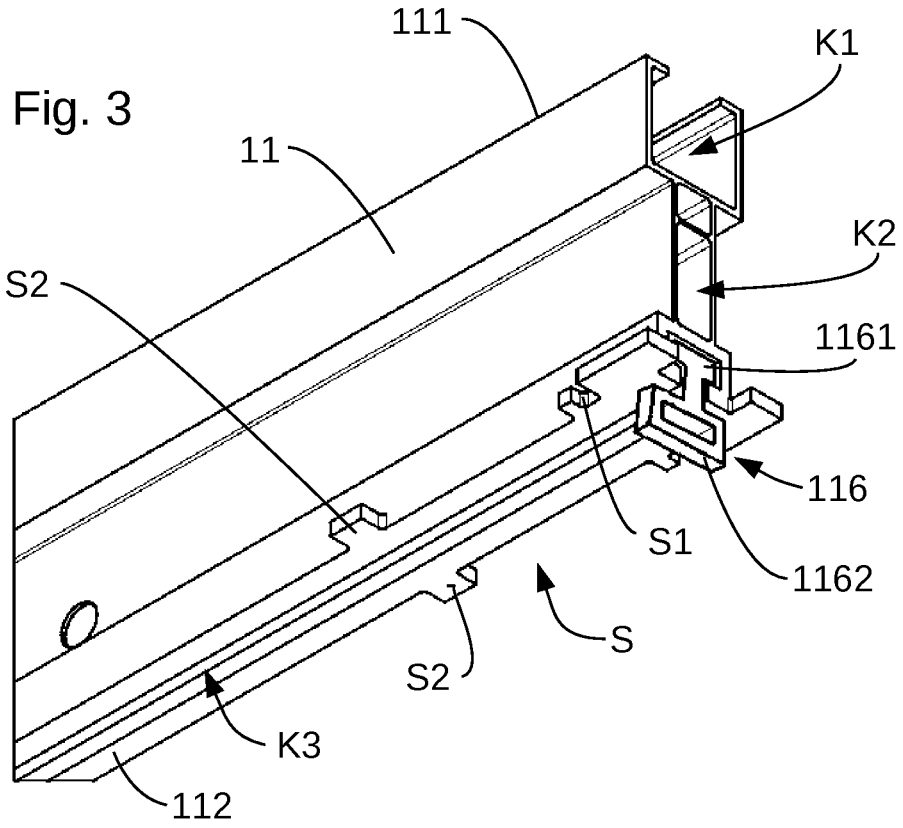
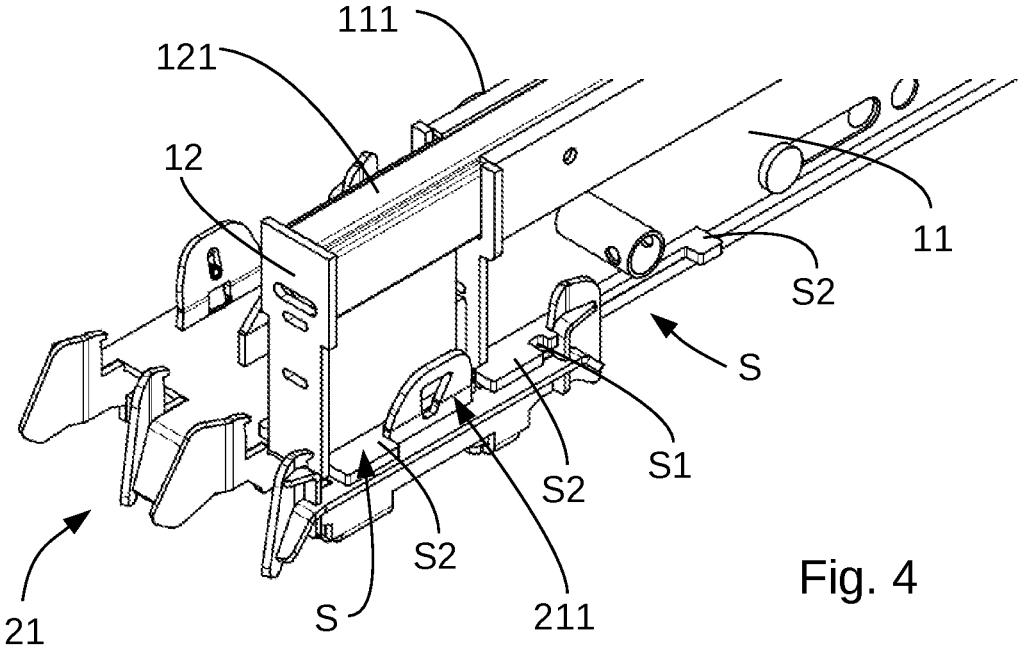
Fig. 4

EQUALIZING BEAM FOR RECEIVING FORMWORK ELEMENTS

The invention relates to an equalizing beam for receiving formwork elements, in particular formwork panels, comprising an outer beam having a support surface facing upwards when applied and a base surface facing downwards when applied, and at least one inner beam having an additional support surface facing upwards when applied and an additional base surface facing downwards when applied. The equalizing beam further comprises at least one immobilizing element. The outer beam has a recess running in its longitudinal direction for receiving the inner beam and the inner beam is movably mounted in the recess of the outer beam. The immobilizing element is provided to secure the position of the inner beam relative to the outer beam. The invention further relates to a ceiling formwork system comprising at least one equalizing beam and at least two supports which are arranged essentially at a right angle to the equalizing beam.

The invention relates to the field of construction. When erecting or converting buildings, parts of the building are often formed by casting concrete. The shape of these cast building parts is determined by formwork, wherein the formwork is erected at the construction site before casting. In particular, ceilings or floor slabs of a building are erected with the aid of formworks. For the construction and positioning of such formworks, there are various types of formwork systems that essentially bring formwork elements into and lock them in a desired position. Said formwork systems comprise vertically running supports and horizontally running beams, wherein the actual formwork elements are applied directly or indirectly to the beams. Known formwork systems are based on standard components which are designed to receive and immobilize standard sizes of formwork elements. When producing ceilings or floor slabs, the majority of the required formwork is usually positioned using standard components. The building parts in which a ceiling is supposed to be created frequently have dimensions that cannot be completely covered by standard components of a formwork. Edge regions remain in which formwork with standard components is not possible because the building parts have, for example, an irregular shape. In order to be able to produce a continuous ceiling, formwork elements must also be provided in said edge regions which, in particular, also relate to the corners of the building parts. The required sizes and shapes of formwork elements for the edge regions are cut out of standard components or shaped in some other way. Usually, the formwork elements for the edge or corner regions are positioned and immobilized by means of beams made individually for this particular application, wherein said individual beams are connected to supports. The disadvantage of this procedure is that this producing of individual beams for the formwork of the edge or corner regions is time-consuming. In addition, there is a risk that individual beams produced under time pressure may not meet the static requirements for casting the building parts and thus there is a risk that such an individually produced formwork system may collapse.

From EP 2 982 813 A1, a beam for a formwork is known, which is designed to be adjustable in length. However, the proposed beam is only suitable for edge regions of a ceiling formwork, which have smaller dimensions because a connection to vertically running supports is only possible at their ends.

A further length-adjustable beam which can be used for the edge regions of a ceiling formwork is known from ES2302655A1. Said beam consists of many different individual parts and its production is therefore elaborate.

Therefore, the problem addressed by the invention is that of proposing solutions with which edge regions of a formwork with different dimensions can be positioned and immobilized easily and reliably.

This problem of the invention is solved by an equalizing beam for receiving formwork elements, in particular formwork panels, comprising an outer beam having a support surface facing upwards when applied and a base surface facing downwards when applied, at least one inner beam having an additional support surface facing upwards when applied and an additional base surface facing downwards when applied, and at least one immobilizing element. The outer beam has a recess running in its longitudinal direction for receiving the inner beam and the inner beam is movably mounted in the recess of the outer beam. The immobilizing element is provided for immobilizing the position of the inner beam relative to the outer beam, wherein said immobilizing is carried out detachably by the immobilizing element and the immobilizing element penetrates the outer beam and the inner beam at least partially during immobilization, and wherein the support surface and the additional support surface are arranged in a common plane which delimits the equalizing beam at the top when applied. At least two support interfaces for connecting to a support are arranged on the base surface and at least one support interface is arranged on the additional base surface. An equalizing beam according to the invention is designed to be adjustable in length and is therefore adjustable to the dimensions required at the construction site. The equalizing beam comprises an outer beam which at least partially encloses an inner beam that is movable relative to the outer beam. The total length of the outer beam is adjustable by moving the inner beam relative to the outer beam. In order to immobilize a set length of the equalizing beam, at least one immobilizing element is provided which determines the position of the inner beam relative to the outer beam. For adjusting the required length of the equalizing beam, the immobilizing element can be removed or deactivated, so that the inner beam is movable relative to the outer beam. Once the desired length is set, the immobilizing element is activated, wherein, in the activated state, i.e., in the state in which the adjusted length of the equalizing beam is set, it at least partially penetrates the outer beam and the inner beam. As a result of said at least partial penetration of the outer beam and the inner beam, a detachable immobilization is achieved by an interlocking connection in combination with the immobilizing element. The outer beam of an equalizing beam according to the invention has a plurality of surfaces. "When applied" refers to the case in which an equalizing beam according to the invention for receiving and positioning formwork elements is or will be installed at the construction site. When applied, the equalizing beam is oriented such that it can absorb load from formwork elements arranged vertically above the equalizing beam. When applied, the equalizing beam is simultaneously oriented such that it can transfer the load transmitted by the formwork elements to supports arranged below the equalizing beam. A typical application for an equalizing beam is its installed state in a ceiling formwork system. In its interior, the outer beam has a recess which is provided for movably receiving the inner beam. Said recess is arranged in the outer beam along its longitudinal direction. The recess in the outer beam can have a one-piece or multipiece design. In this case, the recess at least partially forms a negative shape relative to the inner beam. The external cross-section of the inner beam thus fits, with play required for the movability of the two supports to one another, into the internal cross-section of the recess of the outer beam. This interlocking connection provided at least in regions between the outer beam and the inner beam ensures precise guidance of the inner beam in the outer beam. In addition, a good force or load transmission is provided between the outer beam and the inner beam, and vice versa. The outer beam has a support surface facing upwards when applied. Said support surface is provided for directly receiving formwork elements, for example, formwork panels. The support surface thus forms the surface on the outer beam, via which loads from the formwork supported by the equalizing beam are introduced into the outer beam. Advantageously, the support surface is designed to be extensive and extends over the entire length of the outer beam. On the side of the outer beam opposite the support surface, a base surface is arranged which faces downwards when applied. This base surface is provided for connecting the equalizing beam to supporting elements. For example, the base surface can be connected to scaffolding supports which support the equalizing beam in the desired position. The base surface is therefore provided for deflecting loads or forces from the equalizing beam. In an analogous manner, the inner beam has an additional support surface facing upwards when applied and which is also used to absorb loads. Furthermore, the inner beam has an additional base surface facing downwards when applied and which is arranged opposite the additional support surface and used to deflect loads from the equalizing beam. According to the invention, the support surface and the additional support surface, when applied, are arranged in a common plane when the inner beam is at least partially inserted into the outer beam. The support surface and the additional support surface thus form a common, continuous plane, via which loads from the overlying formwork elements can be absorbed. The plane defined jointly by the support surface and the additional support surface simultaneously delimits the equalizing beam at the top when applied. This means that no further elements of the equalizing beam protrude upwards beyond said common plane and impede the application of formwork elements. An equalizing beam according to the invention thus has a plane which delimits it at the top when applied and which is formed by the two surfaces, namely the support surface and the additional support surface, which can be moved relative to one another. Formwork elements, such as formwork panels, can be applied in a planar manner and without intermediate elements directly to the support surface and the additional support surface, wherein this direct application ensures a very good load transfer. At least two support interfaces for connecting to a support are arranged on the base surface of the outer beam and at least one support interface is arranged on the additional base surface of the inner beam. An equalizing beam according to the invention has at least three support interfaces which are provided for connecting to supports, via which the loads introduced into the equalizing beam by the formwork are deflected again from said equalizing beam. Two of these support interfaces are arranged on the outer beam, in particular at its ends. Usually, the outer beam is designed to be sturdier than the retractable and extendable inner beam. The main load introduced into the equalizing beam by overlying formwork elements is thus absorbed and transmitted by the outer beam. In every application at the construction site, the outer beam with its two support interfaces is used to transfer the load. The inner beam is used to adjust the equalizing beam to different dimensions which are specified by the dimensions of the required formwork. The inner beam is thus moved relative to the outer beam until the total length of the equalizing beam matches the application. In this state, the immobilizing element is then immobilized or activated. Supports are arranged on the outer beam via its two support interfaces. The inner beam has a further support interface which is also provided for connecting to a support. In particular, loads which are introduced into the inner beam via the additional support surface are deflected via said third support interface on the inner beam. The third support interface on the inner beam thus absorbs the portion of the load that is not absorbed by the outer beam. In the usual application, supports are arranged at all three support interfaces of the equalizing beam, which deflect the load downwards. However, if there is an application in which the inner beam is inserted completely into the outer beam because no greater overall length is required, it is possible that an equalizing beam according to the invention is only connected at the two support interfaces to supports arranged on the outer beam. An equalizing beam according to the invention thus has an arrangement of support interfaces which is adjusted to its respective length and allows for a distributed deflection of the absorbed load. With the three support interfaces provided, said load is better deflected and distributed than in the prior art in which only two support interfaces are usually provided.

In one embodiment, it is provided that the outer beam is designed to be rod-shaped and at its two front ends, it has an insertion opening which is connected to the recess and the inner beam is insertable into the outer beam through said insertion openings at both front ends. In this embodiment, an insertion opening forms the access to the recess in the interior of the outer beam. Since such an insertion opening is arranged at two opposite ends of the outer beam, the inner beam can be inserted into both front ends of the outer beam. For this purpose, the insertion opening is designed to be the same size or larger than the outer cross-section of the inner beam. The inner beam, adjusted to the individual requirements at the construction site, can be inserted through the two insertion openings either on one or, alternatively on the other, opposite end of the outer beam and positioned relative to it. An equalizing beam according to this embodiment can thus be adjusted particularly well to the individual circumstances of an application. Due to the two-sided insertability, there is increased flexibility for arranging the supports at the support interfaces. In addition, when constructing a formwork, it must always be taken into account where the necessary supports for the equalizing beam can be set up. If an opening, such as a shaft in the floor of the building part, is provided in a specific region in which a ceiling formwork is to be set up, then no support for immobilizing the ceiling formwork can be placed in this region. In this case, the inner beam can be inserted into the outer beam from the other side, which also changes the position of the support interfaces and thus the position of the supports connected to them. In most cases, this allows for the support arrangement to be easily adjusted to the present circumstances.

Furthermore, it is provided that the support surface extends over the entire length of the outer beam and the additional support surface extends over the entire length of the inner beam and the support surface and the additional support surface are provided for directly supporting one or more formwork elements. In this embodiment, the total support surface formed by the support surface and the additional support surface extends over the entire length of the equalizing beam. Said total support surface is provided for directly supporting one or more formwork elements, in particular for directly supporting formwork panels. Since the total support surface always extends over the entire length of the equalizing beam regardless of the positioning of the inner beam relative to the outer beam, formwork elements placed on the total support surface lie flat and without interruptions on the equalizing beam. As a result, no stress peaks occur at the surface boundaries. The extensive continuous support of formwork elements along the entire equalizing beam allows for a particularly good load transfer from one or more formwork elements into the equalizing beam. By extending the total support surface over the entire length of the equalizing beam, applied formwork elements can have a wide variety of dimensions and, in particular, joints at a wide variety of positions. The continuous total support surface always ensures that adjacent formwork elements always rest on the support surface at their joint and are thus reliably supported.

It is advantageously provided that the equalizing beam further comprises a fastening strip which at least partially has the same shape in cross-section as the inner beam and the fastening strip can be inserted into the recess of the outer beam, in particular wherein the recess has an undercut on its side facing the support surface, which secures the fastening strip against a movement in the direction of the support surface when applied. In this embodiment, a fastening strip is provided which is used to secure formwork elements placed on the equalizing beam. Formwork elements that are placed on the support surface or the additional support surface of the equalizing beam can be immobilized in their position, for example, by driving nails through the formwork elements into the fastening strip. The fastening strip has an outer shape that makes it possible for the fastening strip to be inserted into the recess present in the outer beam. Therefore, the inner beam and the fastening strip can be inserted into the recess. In this case, the fastening strip can also serve as a stop for the inner beam. Optionally, the fastening strip can be shaped such that an undercut of the recess in the outer beam prevents it from being moved out of the recess in the direction of the support surface. Such an undercut prevents formwork elements connected to the fastening strip from being lifted off the fastening strip and thus also from the support surface. However, an undercut or a shape of the fastening strip which engages in the undercut is not absolutely necessary. The fastening strip can also be designed such that it can be removed from the recess and introduced into said recess in the direction of the support surface. A combination of fastening strip and recess thus designed makes it possible to introduce one or more fastening strips when the equalizing beam is already in position.

In a further embodiment, it is provided that the fastening strip has a fastening surface facing upwards when applied, wherein the fastening surface is flush with the support surface when inserted into the outer beam or the fastening surface is set back relative to the support surface. In this embodiment, the fastening strip has a fastening surface which is provided for introducing connecting elements for connecting to a formwork element. In a simple embodiment, the fastening strip can be made of wood or plastic and the fastening surface can be used as a surface for driving in nails. In order to ensure the continuous and flat total support surface described above, the fastening surface is arranged flush with the support surface or set back with respect to the support surface.

In one embodiment of the equalizing beam, it is provided that the inner beam has a plurality of immobilizing openings which are arranged to be spaced apart from one another in the longitudinal direction on the inner beam, and the outer beam has at least one immobilizing guide, wherein the immobilizing element for immobilizing the position of the inner beam in the outer beam is introduced at least partially into the immobilizing guide and one of the immobilizing openings. In this embodiment, the inner beam is detachably immobilized at the outer beam by a combination of an immobilizing opening in the inner beam, an immobilizing guide on the outer beam, and the immobilizing element. In order to achieve an adjustability of the total length of the equalizing beam, a plurality of immobilizing openings spaced apart from one another is arranged on the inner beam. The position of the inner beam relative to the outer beam can be adjusted according to the distances between the immobilizing openings. When immobilizing the inner beam on the outer beam, the immobilizing element is at least partially introduced both into the immobilizing guide and into one of the immobilizing openings, so that an interlocking connection is created.

In a further embodiment, it is provided that the immobilizing openings and the immobilizing guide are designed as cylindrical openings and the immobilizing element is at least partially designed as a cylindrical pin. In this embodiment which is particularly easy to manufacture, the immobilizing openings and the immobilizing guide are designed as openings with a cylindrical cross-section. Such openings can easily be produced by drilling or milling. The immobilizing element is provided with a cylindrical outer cross-section that matches the openings and fits into the openings.

In an alternative embodiment, it is provided that the immobilizing openings are designed as cylindrical openings and the immobilizing guide is designed as an elongated hole and the immobilizing element is at least partially designed as a cylindrical pin. In this embodiment, the immobilizing guide on or in the outer beam is designed as an elongated hole, wherein the elongated hole is arranged in the longitudinal direction on the outer beam. The position of the inner beam relative to the outer beam can be roughly adjusted by selecting an immobilizing opening on the inner beam. The immobilizing element is subsequently introduced into the immobilizing guide designed as an elongated hole and the selected immobilizing opening. This creates an interlocking connection between the immobilizing opening and the immobilizing element. However, the immobilizing element is movable in the immobilizing guide because there is no interlocking connection in the longitudinal direction of the outer beam between the at least partially cylindrical immobilizing element and the immobilizing guide designed as an elongated hole. The immobilizing element can thus be moved over the length of the elongated hole, which allows for a fine adjustment of the total length of the equalizing beam or a fine adjustment of the position of the inner beam relative to the outer beam. An equalizing beam according to this embodiment is thus even more adjustable to the individual dimensions of a specific application. In one simple embodiment, the immobilizing element is designed as a cylindrical pin or a cotter pin. Such an immobilizing element can be flexibly attached to the outer beam via a rope or a chain, so that the immobilizing element is not accidentally lost if it is not inserted into the outer beam or the inner beam for immobilization.

Furthermore, it is provided that the outer beam has at least one coupling and a coupling seat, wherein the coupling and the coupling seat are arranged on opposite side surfaces of the outer beam, wherein the side surfaces of the outer beam are surfaces which are arranged at an angle, in particular at a right angle, to the support surface and to the base surface, wherein the outer geometry of the coupling is smaller than or equal to the inner geometry of the coupling seat and thus the coupling of an equalizing beam can be inserted into the coupling seat of a further equalizing beam and thus two equalizing beams can be connected to one another. In this embodiment, at least one coupling and at least one coupling seat are provided on the outer beam, which are used to connect two or more equalizing beams to one another. Coupling and coupling seat allow for such a connection of a plurality of equalizing beams at a small distance from one another. A mechanical connection between two or more equalizing beams significantly increases the tilt stability of the assembly when compared to a single equalizing beam. In this case, "tilt stability" refers to the stability that counteracts the tilting away of the equalizing beam, the formwork system and in particular the formwork elements when the poured concrete is applied. The coupling and the coupling seat are each arranged on side surfaces. Said side surfaces are different surfaces than the previously described support surface and base surface. Usually, the side surfaces are each arranged at a right angle to the support surface and the base surface. Depending on the shape of the outer beam, the side surfaces can also be arranged at a different angle to the support surface and the base surface. In order to be able to connect a plurality of equalizing beams to one another, a coupling is usually arranged on one side surface and a coupling seat is arranged on the opposite side surface. In the event that only two equalizing beams are supposed to be connected to one another, it is also possible to arrange a coupling and a coupling seat on one and the same side surface of the outer beam. For connecting two equalizing beams, the coupling of one equalizing beam is introduced into the coupling seat of a further equalizing beam. In order to make this introduction possible, the outer geometry of the coupling is designed to be smaller than or equal to the inner geometry of the coupling seat. For a connection, the external geometry of the coupling can thus be introduced into the internal geometry of the coupling seat.

Advantageously, it is provided that the coupling has a cylindrical outer cross-section and the coupling seat has a rectangular inner cross-section. In this embodiment, the external cross-section of the coupling fits into the internal cross-section of the coupling seat but without having an identical shape. The outer cross-section of the coupling is designed to be cylindrical, while the inner cross-section of the coupling seat is designed to be rectangular, in particular square. When the coupling is introduced into the coupling seat, the two elements bear against one another at several points but there are also remaining regions of the rectangular cross-section in the coupling seat in which no part of the coupling is located. This has the advantage that, under the rough operating conditions at a construction site, there is a tolerance of the connection with regard to contamination. If there is contamination, for example, from concrete residues, gravel or sand, in the inner cross-section of the coupling seat, said contamination can move to the regions that are not occupied by the coupling in the coupling seat when the coupling is introduced. Light contaminations thus do not impede a connection between the coupling and the coupling seat. Of course, other combinations of the external cross-section of the coupling and the internal cross-section of the coupling seat are also conceivable, which leave out regions in which contaminations can accumulate. The embodiment is therefore not limited to a cylindrically designed coupling and a rectangularly designed coupling seat.

Furthermore, it is provided that the coupling seat has at least one securing element and the coupling has at least one securing seat, wherein the securing element can be meshed with the securing seat after the coupling of an equalizing beam has been introduced into the coupling seat of a further equalizing beam and in the introduced state, a separation of the coupling and the coupling seat is prevented. In this embodiment, the connection between the coupling of an equalizing beam and the coupling seat of a further equalizing beam can be secured, so that an unintentional separation of the two equalizing beams is prevented. After the coupling and the coupling seat have been put together or otherwise connected, the securing element of the coupling seat is introduced into the securing seat of the coupling. The securing element of the coupling seat can be designed, for example, as a pivotable bracket which is arranged on the coupling seat in an undetachable manner. In combination with such a pivotable bracket on the side of the coupling seat, a simple planar key surface can be provided on the coupling with which regions of the securing element designed as a bracket are meshed. The solution described has the advantage that the securing element and the securing seat are easy to attach and cannot be lost accidentally. Alternatively, the securing element of the coupling seat can also be formed by a cotter pin which, for securing purposes, can be inserted into a securing seat formed by a cylindrical bore in the coupling. Such a cotter pin can, for example, also be secured against accidental loss by fastening it to a piece of wire or a chain.

In one embodiment of the proposal, it is provided that the coupling and the coupling seat protrude at a right angle over the respective side surfaces of the outer beam. In this embodiment, both the coupling and the coupling seat are rod-shaped, i.e., they have a longitudinal axis that is longer than their width. The coupling and the coupling seat are arranged on the side surface or side surfaces of the outer beam such that their longitudinal axis is at a right angle to the side surfaces. This right-angled arrangement in relation to the side surfaces ensures that, when a plurality of equalizing beams is connected to one another, their support surfaces are positioned in one plane and parallel to one another. Advantageously, it is provided that a coupling and a coupling seat are arranged on each side surface of the outer beam, wherein the coupling is arranged on the first side surface opposite the coupling seat on the second side surface and the coupling seat is arranged on the first side surface opposite the coupling on the second side surface. In this embodiment, one coupling and one coupling seat are arranged on each of the two side surfaces of the outer beam. An equalizing beam thus designed can be connected to a further equalizing beam via two connections each comprising a coupling and a coupling seat. This connection at two points on the outer beam is particularly stable. In order to achieve an assembly of a plurality of equalizing beams in the manner of a chain, the corresponding elements for a connection are arranged on each of the two side surfaces. An equalizing beam can thus be connected to a further equalizing beam on both of its sides. A coupling and a coupling seat are preferably arranged on a first side surface, and a coupling seat and a coupling are arranged in a mirror-inverted manner on the second side surface opposite said first side surface. Alternatively, however, a coupling and a coupling seat can also be arranged opposite one another on each side.

Furthermore, it is provided that the outer beam is formed by a profile element, wherein the profile element has at least two chambers which are arranged one above the other when applied. In this embodiment, the outer beam comprises a profile element or is formed by a profile element. "Profile element" refers to an element that has a constant cross-section which extends along an axis or a curve. A profile element in which a complex profile extends along a linear axis is usually used for producing an outer beam. Such profile elements are available on the market in a wide variety of designs, for example, made of iron-based or aluminum materials. Profile elements have the advantage that, based on the principles of lightweight construction, they have high flexural rigidity with little material requirement. Profile elements are therefore sturdy and have a low weight, which is particularly favorable for handling at the construction site. A profile element according to the embodiment described has at least two chambers arranged one above the other in its cross-section. Said chambers form different regions in the profile element and can be used for different purposes. The two chambers are usually separated from one another by a partition. An arrangement of the chambers one above the other is particularly advantageous because it increases the bending resistance of the outer beam against a load which is introduced into and enlarged on the support surface.

In a further embodiment, it is provided that the outer beam formed by a profile element has a third chamber which is arranged below the two chambers when applied. In this embodiment, the profile element has a further, third chamber. Said third chamber is preferably arranged below the first and the second chamber. The third chamber is used to further increase the flexural rigidity of the equalizing beam. In addition, the third chamber of the profile element can be used for further functions, for example, for additional fastening or anchoring of the outer beam in the formwork system.

Advantageously, it is provided that the support interfaces of the outer beam are arranged on or in the second chamber or on or in the third chamber, in particular wherein the support interfaces have regions which are formed by recesses or projections of the second or the third chamber. In this embodiment, the support interfaces of the outer beam, which are arranged on the base surface, are arranged either on the downward-facing edge of the second chamber or the third chamber when applied. The support interfaces are always located on the downward-facing base surface of the outer beam when applied, said base surface closing off the outer beam at the bottom. If the outer beam is formed by a profile with two profile chambers, the support interfaces are arranged at the lower edge of the second chamber. In the case of an outer beam having three profile chambers, the support interfaces are correspondingly arranged at the lower edge of the third chamber. The support interfaces are provided to be connected to support heads of supports in a formwork system. The support interfaces usually have geometric shapes which form an interface that match corresponding counterparts of geometric shapes on the support head. For example, the support interfaces have projections or recesses which are provided for a targeted connection to a support head. Said projections or recesses can be produced by removing material of the second or third chamber of the equalizing beam. Such a removal of material can take place, for example, by laser cutting, milling, sawing or other processing methods.

Furthermore, it is provided that the outer beam comprises at least one eyelet element which is movably and securably arranged in the base surface, in particular wherein the eyelet element is at least partially arranged in the third chamber. In this embodiment, at least one eyelet element is arranged on the outer beam. Said eyelet element is arranged in or on the base surface where it can be moved in the longitudinal direction of the outer beam. The eyelet element can be immobilized at different positions along the base surface. The eyelet element has an eyelet which can be connected to a means for bracing, for example, a rope or a chain. Said means for bracing can be used to anchor the outer beam relative to other elements at the construction site when applied. Loads and forces introduced into the equalizing beam can be deflected via such bracing in addition to being deflected via the support interfaces. The stability of the positioning of the equalizing beam is thus additionally increased by such an eyelet element. In addition to the eyelet, the eyelet element has a fastening part which engages in the lower chamber of the outer beam designed as a profile element. Usually, the eyelet element is movably attached in the third chamber which also forms the base surface. In an embodiment of an outer beam with only two chambers, the eyelet element is attached in the second chamber which is oriented downwards when applied.

In one advantageous embodiment, it is provided that the inner beam has at least two rods extending in its longitudinal direction, which are spaced apart from one another and which are connected at their ends by end elements. In this embodiment, the inner beam has a multipiece design in the longitudinal direction. For this purpose, the inner beam has two rods arranged one above the other and spaced apart when applied. The structure of the inner beam with two such rods increases its flexural rigidity when applied. An inner beam with a two-piece design which has a distance between two rods running in the longitudinal direction is also lightweight and therefore easy to transport. In this embodiment, the inner beam is also constructed according to the principles of lightweight construction and combines high mechanical stability for absorbing loads introduced via the additional support surface with low weight. The two rods running in the longitudinal direction are firmly connected to one another at their two end faces by means of end elements. The end elements position the two rods in relation to one another.

In a further embodiment, it is provided that at least one support interface of the inner beam is arranged on one of the end elements. In this embodiment, the at least one support interface of the inner beam is arranged on an end element. The end of the end element, which faces downwards when applied, forms part of the additional base surface and is therefore a suitable location for arranging a support interface. This support interface can also have projections, recesses or other geometric shapes which are provided for connecting to a support head. However, alternatively or additionally, support interfaces can also be arranged on the lower of the two rods of the inner beam. In general, it is possible to place the entire equalizing beam with its surface facing downwards when applied on supports of a formwork system. As described, at least three support interfaces are provided. In addition, supports can be attached at other points to provide additional support for the equalizing beam at any position. Due to this option of attaching additional supports, an equalizing beam or a formwork system having an equalizing beam can be adjusted very flexibly to different requirements at the construction site.

Furthermore, it is advantageously provided that at least one transverse connector is provided which has two opposite ends, at each of which a connection is provided and the outer beam has at least one transverse connector interface that can be connected to the connection on the first side of the transverse connector and the connection can be connected on the second side of the transverse connector to the transverse connector interface of a further equalizing beam, resulting in two or more equalizing beams being connectable at a distance from one another. This embodiment provides a further option for connecting a plurality of equalizing beams to one another. For this further connection option, at least one transverse connector is provided which has a connection at two of its opposite ends. Said connection can be connected to at least one transverse connector interface on the equalizing beam. The second, opposite connection of the transverse connector can be connected to a transverse connector interface of a further equalizing beam. In this manner, two or more equalizing beams can be connected at a distance from one another. In this case, the transverse connector is designed to be longer than the previously described combination of coupling and coupling seat. The transverse connector thus allows two or more equalizing beams to be arranged at a greater distance from one another than with a connection via the combination of coupling and coupling seat. The transverse connector can be designed to be rod-shaped with a length dimension that is significantly larger than its width dimension. The cross-section of a transverse connector can be designed to be, for example, circular. Of course, other cross-sections can also be used for a transverse connector.

The problem of the invention is further solved by a ceiling formwork system comprising at least one equalizing beam according to one of the embodiments described above and at least two supports which are arranged essentially at a right angle to the equalizing beam. The supports each have a support head and the support head of each support is connected to a support interface of the outer beam. A ceiling formwork system according to the invention comprises at least one equalizing beam according to one of the previously described embodiments. The equalizing beam is provided for directly supporting formwork elements, in particular formwork panels. In the case of a ceiling formwork system according to the invention, the equalizing beam is positioned by at least two supports which are vertically oriented when applied. In this case, the two supports are arranged essentially at a right angle to the longitudinal direction of the equalizing beam. The ends of the supports, which are oriented upwards when applied, each have a support head which is each connected to a support interface of the outer beam of the equalizing beam. By connecting the support interfaces to the support head of the supports, a stable positioning of the ceiling formwork system is ensured when applied.

In one embodiment, it is provided that the support head of the support has at least one head seat which interlockingly receives at least partial regions of the support interface, in particular wherein the at least one head seat receives at least one recess or at least one projection of the support interface in an interlocking manner. In this embodiment, an at least partially interlocking connection is provided between the support interface and a head seat which is part of the support head of each support. Such an interlocking connection allows equalizing beams and support heads to be connected to one another in a reproducible manner. A corresponding arrangement of geometric elements, for example, projections or recesses, can also be used to realize a reproducible movability of equalizing beams and supports with respect to one another. For example, when constructing the ceiling formwork system, such geometric elements can be used initially to hook an equalizing beam into the head seat on a support head. The equalizing beam is already guided relative to the support head via said geometrical elements after it has been hooked in. Guided by these first geometric elements, the equalizing beam can then be moved into the desired position, for which purpose it is usually folded upwards in an essentially horizontal direction. The connection between the two elements can then be secured in a targeted manner and immobilized in its position via further geometric elements on the support interfaces and on the support head. In this case, the shape of the support interfaces and the head seat can be designed differently. However, according to the embodiment described, the shape of the support interfaces and the head seat are matched such that, when the ceiling formwork system is applied, an interlocking connection between the elements is created at least in regions. The interlocking connection described can be additionally stabilized by force-locking elements at the support interfaces or the head seat. Such elements acting in a force-locking manner can be formed, for example, by clamps.

It is advantageously provided that a third support is provided, the support head of which is connected to the support interface of the inner beam. In this embodiment of a ceiling formwork system, a third support is provided which is connected to the inner beam of the equalizing beam. Such a third support is required when the inner beam is at least partially extended with respect to the outer beam and protrudes over said outer beam. In this case, the loads that are absorbed by the inner beam are at least partially deflected via the third support which is connected to the support interface of the inner beam. The position of said third support relative to the other two supports which are connected to the outer beam varies with the extension length of the inner beam relative to the outer beam. By providing the third support connected to the inner beam, a safe load transfer from the entire equalizing beam is ensured. For this purpose, one of the two supports connected to the outer beam is usually arranged at the end of the outer beam over which the inner beam protrudes. Said support is therefore located at the transition region between the inner beam and the outer beam, where it absorbs loads. This ensures that precisely said transition region in which the inner beam emerges from the outer beam is securely supported and not stressed or damaged by bending stresses.

In a further embodiment, it is provided that at least two equalizing beams are provided which are each connected to the support heads of supports at at least two support interfaces, wherein the coupling of one equalizing beam is connected to the coupling seat of the second or further equalizing beam. In this embodiment, the ceiling formwork system has more than one equalizing beam. In this case, two or more equalizing beams are connected to one another via a combination of coupling and coupling seat. Due to this connection, the at least two equalizing beams provided are spaced apart from and connected parallel to one another. In this way, two or more equalizing beams can be arranged next to one another in a stable and reproducible manner. Such an arrangement of a plurality of equalizing beams increases the stability of the ceiling formwork system. In addition, larger regions of a formwork, for example, in the edge or corner regions of building parts, can be supported. The adjustability of the length of the individual equalizing beams is particularly advantageous because it results in a very good adjustment period of the ceiling formwork system to a variety of different geometries of the required formwork. Alternatively or additionally, a plurality of equalizing beams can also be connected to one another via transverse connectors which are attached to the outer beam of the equalizing beams via transverse connector interfaces.

Features that are disclosed in connection with the equalizing beam are also disclosed analogously in connection with the ceiling formwork system. The same applies in reverse.

The figures schematically show embodiments of the invention, in which

FIG. 3 is a perspective partial view of the outer beam of an embodiment of an equalizing beam according to the invention;

FIG. 4 is a perspective partial view of an embodiment of an equalizing beam according to the invention connected to a support head;

In the figures, the same elements are denoted with the same reference signs. In general, the described properties of an element which are described for one figure also apply to the other figures. Directional information, such as above or below, refers to the figure described and can be transferred analogously to other figures.

Figure 1:
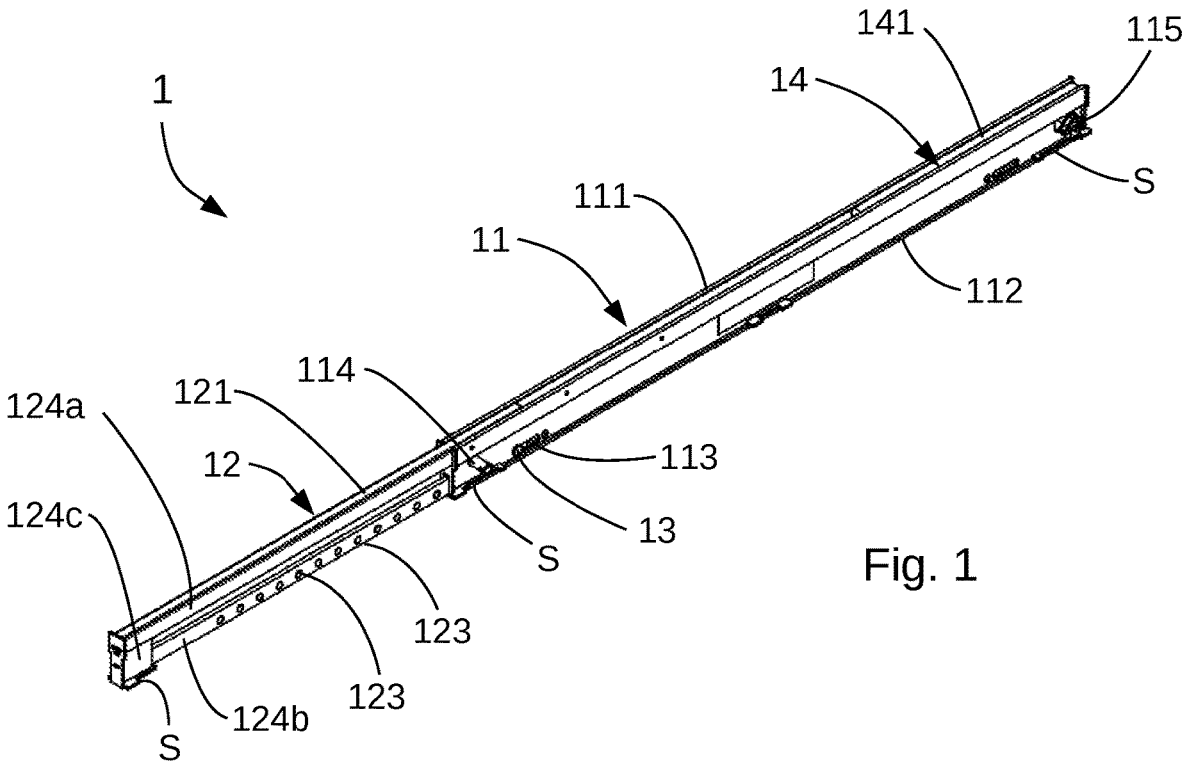
FIG. 1 shows a perspective depiction of an embodiment of an equalizing beam according to the invention.

FIG. 1 shows a perspective depiction of an embodiment of an equalizing beam 1 according to the invention. The equalizing beam 1 comprises an outer beam 11 which in the drawing faces towards the right rear. An inner beam 12 is movably mounted in the outer beam 11. The outer beam 11 is formed by a profile element made of a metal material. In this case, the profile element which forms the outer beam 11 of the depicted embodiment comprises two chambers which are arranged one above the other. In the depiction in FIG. 1, the equalizing beam 1 is oriented as applied at the construction site or in the installed state in a ceiling formwork system 100. The surface delimiting the outer beam 11 at the top is the support surface 111. Said support surface 111 extends over the entire length of the outer beam 11 on both sides of the recess which receives the inner beam 12. When applied, formwork elements are placed directly on the support surface 111. The surface delimiting the outer beam 11 at the bottom is the base surface 112 which is covered up in the depiction in FIG. 1. The base surface 112 is the surface which is provided for connecting to supports 2 which deflect the load from the equalizing beam 1. A support interface S is arranged on the base surface 112 at the end of the outer beam 11 facing forward towards the observer and at its opposite end. Said support interfaces S are provided for directly or indirectly connecting the equalizing beam to supports which have a support head 21 that matches the support interfaces S. In general, it is possible to introduce loads into supports positioned at any point over the entire base surface 112 which also extends over the entire length of the outer beam 11. The two support interfaces S are provided for an at least partially interlocking connection to special supports of the ceiling formwork system 100. Additionally or alternatively, supports which have a planar surface facing upwards without a special interface can be arranged at all other points on the base surface 112, for example, between the support interfaces S. The equalizing beam 1 can thus also be combined with simple aids for constructing a ceiling formwork. In its interior, the outer beam 11 has a recess oriented in the longitudinal direction. In the depicted case, said recess is formed by two profile chambers. At each of its two end faces, the outer beam has an insertion opening which is connected to the recess. In the depicted case, the inner beam 12 is inserted into the outer beam 11 through the insertion opening facing towards the front left. Alternatively, the inner beam 12 could also be inserted at the opposite end of the outer beam 11. The inner beam 12 is delimited at the top by an additional support surface 121 which extends over the entire length of the inner beam 12. On its downward-facing side, the inner beam is delimited by the additional base surface 122 which also extends over the entire length of the inner beam 12. A further support interface S is arranged on the additional base surface 122 at the front end of the inner beam facing the observer. The inner beam 12 comprises two rods 124*a* and 124*b* aligned parallel to and spaced apart from one another. These rods 124*a*, 124*b* are connected at their two ends by end elements 124*c*. The additional support surface 121 is arranged on the upper rod 124*a*. A plurality of immobilizing openings 123, which herein are designed as round bores, is located in the lower rod 124*b*. The immobilizing openings 123 are arranged at a regular distance from one another and are used to detachably immobilize the inner beam 12 in the outer beam 11. An immobilizing guide 113 designed as an elongated hole is arranged on the outer beam 11. Said immobilizing guide 113 is located in one of the two side surfaces which are each arranged at a right angle to the support surface 111 and to the base surface 112. The immobilizing element 13 which herein is designed as a cylindrical pin is inserted into the immobilizing guide 113 and one of the immobilizing openings 123. The immobilizing element 13, in combination with the immobilizing opening 123 and the immobilizing guide 113, establishes a connection between the outer beam 11 and the inner beam 12. As a result, the outer beam 11 and the inner beam 12 can be immobilized relative to one another. The immobilizing element 13 is movable in the longitudinal direction of the beams over the length of the immobilizing guide 113 designed as an elongated hole. As a result, a fine adjustment of the length of the equalizing beam 1 is possible when the immobilizing element 13 is introduced. Of course, the immobilizing guide 113 can also be designed as a cylindrical hole, in which case, however, no fine adjustment of the length of the equalizing beam 1 is possible. On the side face facing forward towards the observer, a coupling 114 is arranged at the front end of the outer beam 11, which is formed by a welded-on pipe piece with a circular outer cross-section. At the end of the outer beam facing towards the rear, a coupling seat 115 is attached to the same side surface, which is formed by a welded-on pipe piece with a square internal cross-section. The coupling 114 and the coupling seat 115 are used to connect two or more equalizing beams 1 to one another. A coupling 114 and a coupling seat 115 can also be present on the opposite side surface of the outer beam 12. At the end of the outer beam 12 facing towards the rear, a fastening strip 14 is inserted into the recess. This fastening strip 14 has an upwardly oriented fastening surface 141. In the inserted state of the fastening strip 14, said fastening surface 141 is set back slightly with respect to the support surface 111. The fastening strip 14 is movable within the recess of the outer beam 12 and used to immobilize or fasten formwork elements which are placed on the equalizing beam 1. In this case, the fastening strip 14 is made of plastic. For fastening formwork elements on the equalizing beam 1, nails can be driven through the formwork elements into the fastening strip 14. Alternatively, regions of the support surface 111 can also be designed such that nails for fastening formwork elements can be driven directly into said regions of the support surface 111.

Figure 2:
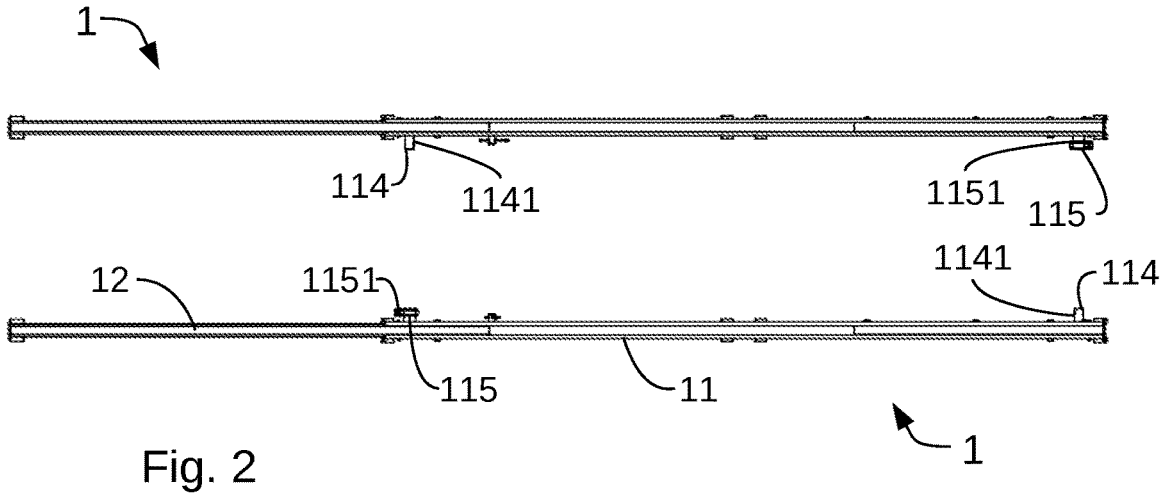
FIG. 2 is a plan view of two embodiments of an equalizing beam according to the invention.

FIG. 2 is a plan view of two embodiments of an equalizing beam 1 according to the invention. The equalizing beam 1 shown above corresponds to the equalizing beam 1 shown in FIG. 1. On the side surface facing downwards in the depiction, a coupling seat 115 is arranged on the left end of the outer beam 11 and a coupling 114 is arranged on the right end of the outer beam 11. The equalizing beam 1 shown at the bottom in FIG. 2 also has a coupling 114 and a coupling seat 115, wherein, however, these two elements are arranged, in terms of the equalizing beam 1 shown above, on the opposite side surface. In contrast to the equalizing beam 1 shown above, the coupling 114 in the equalizing beam 1 shown below is arranged on the left end of the outer beam 11 and the coupling seat 115 is arranged on the right end. Proceeding from the state shown in FIG. 2, the two equalizing beams 1 can be moved towards one another until the two couplings 114 penetrate the two coupling seats 115. In this way, a stable connection between the two equalizing beams 1 can be produced. Said connection is created by a plug connection from the two combinations of coupling 114 and coupling seat 115. In the connected state, the securing elements 1151 of the coupling seats 115 can be meshed with the securing seats 1141 of the couplings 114 in order to secure the connection. In the depicted case, the securing elements 1151 are formed by pivotable brackets which are arranged on the coupling seats 115 in an undetachable manner. In the depicted case, the securing seats 1141 are formed by simple planar key surfaces on the outside of the couplings 114. When the securing elements 1151 are closed, partial regions of said securing elements 1151 engage in the securing seats 1141 and thus immobilize the respective coupling 114 in the respective coupling seat 115. Alternatively to the embodiments shown in FIG. 2, couplings 114 and coupling seats 115 can also be arranged on both side surfaces of the outer beam 11. In this case, a plurality of equalizing beams 1 can be connected in parallel and at a distance from one another when couplings 114 and coupling seats 115 are arranged on both side surfaces. Such a composite of a plurality of equalizing beams 1 has a greater tilt stability than a single equalizing beam 1 when applied.

FIG. 3 is a perspective partial view of the outer beam 11 of an embodiment of an equalizing beam 1 according to the invention. FIG. 3 shows a front end of an embodiment of an outer beam 11. The outer beam 11 is designed as a profile element with a plurality of chambers K1, K2, K3. The first chamber K1 faces upwards when applied and receives a part, in particular the upper rod 124*a*, of the inner beam. The first chamber K1 has an opening towards the support surface 111. This opening is designed such that any contaminations that have penetrated the chamber K1, for example, concrete residues, sand or the like, can be removed from the chamber with a simple tool. The opening also offers the possibility of reaching the fastening surface 141 of an inserted fastening strip 14. Such a fastening strip 14 is not shown in FIG. 3. A second chamber K2 is arranged below the first chamber K1, which is also used to guide part of the inner beam 11, in particular to guide the second rod 124*b*. In the depicted embodiment, the two chambers K1 and K2 form the recess which runs through the outer beam 11 in the longitudinal direction. A third chamber K3 is arranged below the second chamber K2. This third chamber K3 is separated from the second chamber K2 by a partition. The base surface 112 is located on the edge of the third chamber K3 facing downwards. A support interface S is arranged at the front end of said base region 112. In this case, said support interface S has a plurality of recesses S1 and a plurality of projections S2. The recesses S1 and the projections S2 together form a geometric shape of the support interface S, which is provided for an interlocking connection to a support head 21. This shape of the support interfaces S with recesses S1 and projections S2 can be produced, for example, in that these elements are created from the profile element which forms the outer beam 11 by laser cutting, milling or similar processing methods. In the depicted embodiment, the profile element which forms the outer beam 11 is made of an iron-based material or an aluminum alloy. The third chamber K3 has an opening towards the base surface 112. Adjacent to said opening, an eyelet recess is located in the interior of the chamber K3, which is provided for receiving one or more eyelet elements 116. Such an eyelet element 116 is shown at the edge of the outer beam 11. In the third chamber K3, the fastening part 1161 of the eye element 116 is located, which is held in place in the third chamber K3 by an undercut formed by the chamber K3 and its opening towards the base surface 112. The actual eyelet 1162 which is firmly or flexibly connected to the fastening part 1161 is located below the base surface 112. Along the third chamber K3, the fastening part 1161 can be moved in different ways and thus to different positions. The fastening part 1161 can be clamped in a force-locking manner at any point in the chamber K3, thus immobilizing the position of the eye element 116. Via the eyelet 1162, the outer beam 11 can be connected or braced with other elements or also with building parts when applied. The load transfer from the outer beam 11 can be further improved by such a bracing. It is also possible to arrange a plurality of eyelet elements 116 on an outer beam 11.

FIG. 4 is a perspective partial view of an embodiment of an equalizing beam 1 according to the invention connected to a support head 21. FIG. 4 shows one end of an equalizing beam 1. The inner beam 12 protrudes over the outer beam 11. FIG. 4 clearly shows that the support surface 111 and the additional support surface 121 form a common plane for supporting formwork elements. Below the left end of the equalizing beam 1, a part of a support head 21 of a support 2 can be seen which is connected to the equalizing beam 1 via two support interfaces S. At the end of the outer beam 11 facing towards the left, a first support interface S is located which is made to form an interlocking connection with part of the head seat 211 of the support head 21. Due to said interlocking connection, the first support interface S cannot be pulled off the support head 21. At the end of the inner beam 1 facing towards the left, the support interfaces S of the inner beam are located. This second support interface S is also in an interlocking connection with elements of the head seat 211 of the support head 21. In the depicted case, a support head 21 is thus connected to two support interfaces S of an equalizing beam 1 in an interlocking manner. Alternatively, it is also possible to establish such a connection only via one support interface S. The required interlocking connection is produced by meshing the projections S2 and the recesses S1 of the support interfaces S with elements of the head seat 211.

Figure 5:
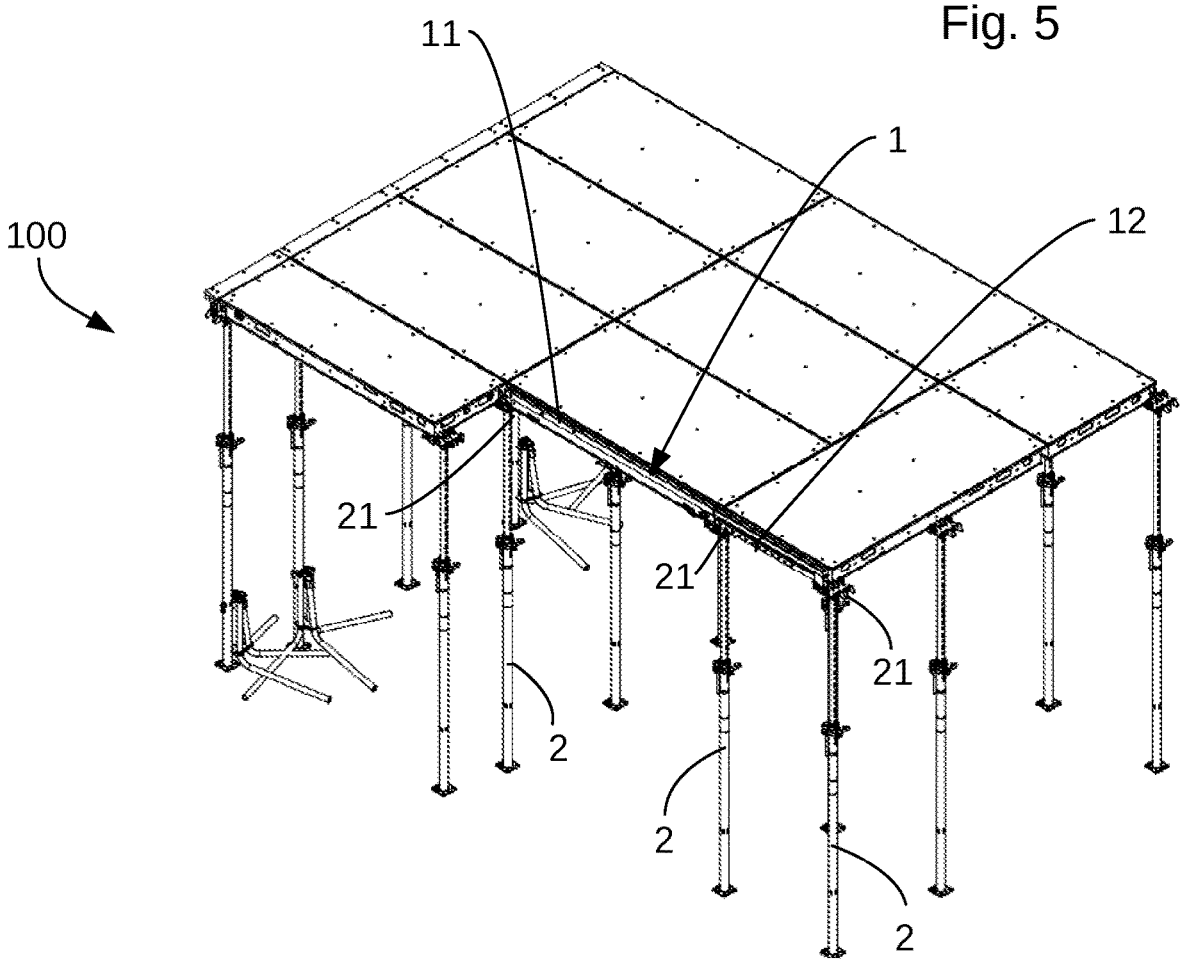
FIG. 5 shows a perspective depiction of an embodiment of a ceiling formwork system according to the invention.

FIG. 5 shows a perspective depiction of an embodiment of a ceiling formwork system 100 according to the invention. The depicted ceiling formwork system 100 has a multiplicity of standard elements of a ceiling formwork. A plurality of standardized formwork panels are arranged on standard beams which in turn are held and positioned by supports 2. At the right front edge of the ceiling formwork system 100, a recess can be seen at which an equalizing beam 1 is arranged. At the point where the recess is in the formwork elements, there could be, for example, a geometric irregularity in the building in which a ceiling is to be poured. For this reason, the recess must be individually provided with formwork elements. For this purpose, an equalizing beam 1 is used which herein is already supported on three supports 2. Each of these supports 2 has a support head 21 which is connected to a support interface S of the equalizing beam. In this case, two supports 2 are attached to support interfaces S of the outer beam 11 and one support 2 is attached to the support interfaces S of the partially extended inner beam 11. Formwork elements can be placed directly on the total support surface formed jointly by the support surface 111 and the additional support surface 121. As can be clearly seen, the partially extended equalizing beam 1 has a length that differs from that of the standard beams. The equalizing beam 1 can be set to a wide variety of lengths, which means that edge regions of the ceiling formwork can be supported and positioned flexibly and individually.

Figure 6:
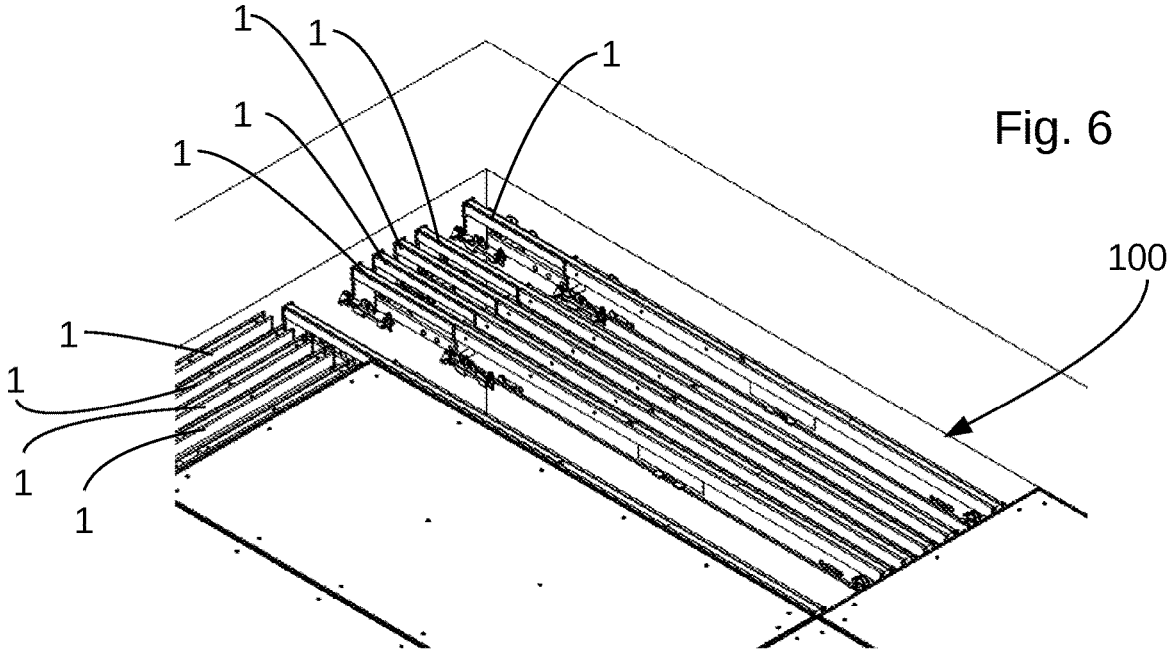
FIG. 6 shows a perspective simplified depiction of an embodiment of a ceiling formwork system according to the invention.

FIG. 6 shows a perspective simplified depiction of an embodiment of a ceiling formwork system 100 according to the invention. FIG. 6 shows a ceiling formwork system 100 under construction, which is arranged in the corner of a room in a building. Formwork elements in standard sizes have already been placed on the ceiling formwork system 100 at the lower and right-hand edge of the drawing. In the depicted case, the remaining corner in which no formwork elements have yet been placed has dimensions that cannot be boarded with standard elements. The standard elements cannot be combined to form the remaining shape and size. For accommodating formwork elements in said remaining region, a plurality of equalizing beams 1 has already been installed. In reality, the equalizing beams 1 are each connected to a plurality of supports 2 which, however, are not shown in FIG. 6 for the sake of clarity. In the larger region of the corner in which no formwork elements have yet been placed, a total of seven equalizing beams 1 with mostly extended inner beams 11 are arranged. In this case, six of said equalizing beams 1 are connected to one another in pairs via combinations of coupling 114 and coupling seat 115. There is only a small distance between said equalizing beams 1 thus connected. Said groups or pairs of equalizing beams 1 are arranged at greater distances from one another. For further stabilization, said groups or pairs can be connected to one another via transverse connectors which are attached to the corresponding side surfaces of the equalizing beams 1 via transverse connector interfaces. Such transverse connectors are not shown in FIG. 6. At the left edge of the remaining corner in which no formwork elements have yet been placed, two further equalizing beams 1 can be seen which, in a plan view, are arranged at a right angle to the seven other equalizing beams 1. An equalizing beam 1 can be arranged in a wide variety of spatial directions, so that many different shapes of edge regions or corners of the room can be filled from a combination of differently oriented equalizing beams 1. This is a decisive advantage of an equalizing beam 1 when compared to the prior art in which ceiling formwork systems usually consist of beams that can only be positioned in one spatial direction or in one alignment to one another. The equalizing beams 1 in the depicted ceiling formwork system 100 thus allow for the support and the positioning of formwork elements with a variety of geometries. Proceeding from the state shown in FIG. 6, individually cut formwork elements can subsequently be applied to the already positioned and secured equalizing beams 1. If necessary, said individual formwork elements can also be fastened to the equalizing beams 1, for example, by means of one or more of the fastening strips 14 described for FIG. 1. After the individual formwork elements have been applied to the equalizing beams 1, the ceiling formwork system 100 is completely assembled and the ceiling of the building portion can be poured.

The invention claimed is:

1. An equalizing beam for receiving formwork elements, comprising:

an outer beam which has a support surface facing upwards when applied and a base surface facing downwards when applied, at least one inner beam which has an additional support surface facing upwards when applied and an additional base surface facing downwards when applied, at least one immobilizing element, wherein the outer beam has a recess running in its longitudinal direction for receiving the inner beam and the inner beam is movably mounted in the recess of the outer beam, and the immobilizing element is provided to immobilize the position of the inner beam relative to the outer beam, wherein said immobilizing is carried out detachably by the immobilizing element and the immobilizing element penetrates the outer beam and the inner beam at least partially during immobilization, and wherein the support surface and the additional support surface are arranged in a common plane which delimits the equalizing beam at the top when applied, and wherein at least two support interfaces for connecting to a support are arranged on the base surface and at least one support interface is arranged on the additional base surface, wherein the outer beam has at least one coupling and a coupling seat, wherein the coupling and the coupling seat are arranged on opposite side surfaces of the outer beam, wherein the side surfaces of the outer beam are surfaces which are arranged at an angle, to the support surface and to the base surface, wherein the outer geometry of the coupling is smaller than or equal to the inner geometry of the coupling seat and thus the coupling of an equalizing beam can be inserted into the coupling seat of a further equalizing beam and thus two equalizing beams can be connected to one another.

2. The equalizing beam according to claim 1, wherein the outer beam is designed to be rod-shaped and comprises two front ends at opposite ends of the outer beam, wherein each of said front ends has an insertion opening which is connected to the recess and the inner beam is insertable into the outer beam through said insertion openings at both front ends.

3. The equalizing beam according to claim 1, wherein the support surface extends over the entire length of the outer beam and the additional support surface extends over the entire length of the inner beam and the support surface and the additional support surface are provided for directly supporting one or more formwork elements.

4. The equalizing beam according to claim 1, wherein the equalizing beam further comprises a fastening strip which at least partially has the same shape in cross-section as the inner beam and the fastening strip can be inserted into the recess of the outer beam, wherein the recess has an undercut on its side facing the support surface, which secures the fastening strip against a movement in the direction of the support surface when applied.

5. The equalizing beam according to claim 4, wherein the fastening strip has a fastening surface facing upwards when applied, wherein the fastening surface is flush with the support surface when inserted into the outer beam or the fastening surface is set back relative to the support surface.

6. The equalizing beam according to claim 1, wherein the inner beam has a plurality of immobilizing openings which are arranged to be spaced apart from one another in the longitudinal direction on the inner beam and the outer beam has at least one immobilizing guide, wherein the immobilizing element for immobilizing the position of the inner beam in the outer beam is introduced at least partially into the immobilizing guide and one of the immobilizing openings.

7. The equalizing beam according to claim 6, wherein the immobilizing openings and the immobilizing guide are designed as cylindrical openings and the immobilizing element is at least partially designed as a cylindrical pin.

8. The equalizing beam according to claim 6, wherein the immobilizing openings are designed as cylindrical openings and the immobilizing guide is designed as an elongated hole and the immobilizing element is at least partially designed as a cylindrical pin.

9. The equalizing beam according to claim 1, wherein the coupling has a cylindrical outer cross-section and the coupling seat has a rectangular inner cross-section.

10. The equalizing beam according to claim 1, wherein the coupling seat has at least one securing element and the coupling has at least one securing seat, wherein the securing element can be meshed with the securing seat after the coupling of an equalizing beam has been introduced into the coupling seat of a further equalizing beam and in the introduced state, a separation of the coupling and the coupling seat is prevented.

11. The equalizing beam according to claim 1, wherein the coupling and the coupling seat protrude at a right angle over the respective side surfaces of the outer beam.

12. The equalizing beam according to claim 1, wherein a coupling and a coupling seat are arranged on each side surface of the outer beam, wherein the coupling is arranged on the first side surface opposite the coupling seat on the second side surface and the coupling seat is arranged on the first side surface opposite the coupling on the second side surface.

13. The equalizing beam according to claim 1, wherein the outer beam is formed by a profile element, wherein the profile element has at least two chambers which are arranged one above the other when applied.

14. The equalizing beam according to claim 13, wherein the outer beam formed by a profile element has a third chamber which is arranged below the two chambers when applied.

15. The equalizing beam according to claim 13, wherein the support interfaces of the outer beam are arranged on or in the second chamber or on or in the third chamber, in particular wherein the support interfaces have regions which are formed by recesses or projections of the third chamber.

16. The equalizing beam according to claim 1, wherein the inner beam has at least two rods extending in its longitudinal direction, which are spaced apart from one another and which are connected at their ends by end elements.

17. The equalizing beam according to claim 16, wherein the at least one support interface of the inner beam is arranged on one of the end elements.

18. The equalizing beam according to claim 1, wherein at least one transverse connector is provided which has two opposite ends, at each of which a connection is provided and the outer beam has at least one transverse connector interface that can be connected to the connection on the first side of the transverse connector and the connection can be connected on the second side of the transverse connector to the transverse connector interface of a further equalizing beam, resulting in two or more equalizing beams being connectable at a distance from one another.

19. A ceiling formwork system, comprising:

at least one equalizing beam according to claim 1, at least two supports which are arranged essentially at a right angle to the equalizing beam, wherein the supports each have a support head and the support head of each support is connected to a support interface of the outer beam.

20. The ceiling formwork system according to claim 19, wherein the support head of the support has at least one head seat which interlockingly receives at least partial regions of the support interface, wherein the at least one head seat receives at least one recess or at least one projection of the support interface in an interlocking manner.

21. The ceiling formwork system according to claim 19, wherein a third support is provided, the support head of which is connected to the support interface of the inner beam.

22. The ceiling formwork system according to claim 19, wherein at least two equalizing beams are provided which are each connected to the support heads of supports at at least two support interfaces, wherein the coupling of one equalizing beam is connected to the coupling seat of the second or further equalizing beam.

23. An equalizing beam for receiving formwork elements, comprising:

an outer beam which has a support surface facing upwards when applied and a base surface facing downwards when applied, at least one inner beam which has an additional support surface facing upwards when applied and an additional base surface facing downwards when applied, at least one immobilizing element, wherein the outer beam has a recess running in its longitudinal direction for receiving the inner beam and the inner beam is movably mounted in the recess of the outer beam, and the immobilizing element is provided to immobilize the position of the inner beam relative to the outer beam, wherein said immobilizing is carried out detachably by the immobilizing element and the immobilizing element penetrates the outer beam and the inner beam at least partially during immobilization, and wherein the support surface and the additional support surface are arranged in a common plane which delimits the equalizing beam at the top when applied, and wherein at least two support interfaces for connecting to a support are arranged on the base surface and at least one support interface is arranged on the additional base surface, wherein the outer beam is formed by a profile element, wherein the profile element has at least two chambers which are arranged one above the other when applied, wherein the inner beam has at least two rods extending in its longitudinal direction, which are spaced apart from one another and which are connected at their ends by end elements.

24. An equalizing beam for receiving formwork elements, comprising:

an outer beam which has a support surface facing upwards when applied and a base surface facing downwards when applied, at least one inner beam which has an additional support surface facing upwards when applied and an additional base surface facing downwards when applied, at least one immobilizing element, wherein the outer beam has a recess running in its longitudinal direction for receiving the inner beam and the inner beam is movably mounted in the recess of the outer beam, and the immobilizing element is provided to immobilize the position of the inner beam relative to the outer beam, wherein said immobilizing is carried out detachably by the immobilizing element and the immobilizing element penetrates the outer beam and the inner beam at least partially during immobilization, and wherein the support surface and the additional support surface are arranged in a common plane which delimits the equalizing beam at the top when applied, and wherein at least two support interfaces for connecting to a support are arranged on the base surface and at least one support interface is arranged on the additional base surface, wherein the outer beam is formed by a profile element, wherein the profile element has at least two chambers which are arranged one above the other when applied, wherein the outer beam formed by a profile element has a third chamber which is arranged below the two chambers when applied, wherein the outer beam comprises at least one eyelet element which is movably and securably arranged in the base surface, wherein the eyelet element is at least partially arranged in the third chamber.

* * * * *